United States Patent [19]

Winter et al.

[11] 4,017,337

[45] Apr. 12, 1977

[54] METHOD FOR PREPARING AN ALUMINUM CLIP

[75] Inventors: Joseph Winter, New Haven; Richard Lanam, Hamden, both of Conn.; Douglas L. Graham, Ballwin, Mo.

[73] Assignee: Swiss Aluminium Ltd., Chippis, Switzerland

[22] Filed: Apr. 9, 1975

[21] Appl. No.: 566,467

[52] U.S. Cl. ..... 148/11.5 A; 24/153 UC; 24/261 PC; 75/141; 75/142; 75/143; 140/82; 148/32

[51] Int. Cl.[2] ..... C22F 1/04

[58] Field of Search ..... 148/11.5 A, 2, 32; 140/82; 24/67 R, 153 UC, 261 PC; 75/142, 141, 146, 147, 143

[56] References Cited

UNITED STATES PATENTS

| | | | |
|---|---|---|---|
| 2,501,440 | 3/1950 | Dix | 75/142 |
| 3,232,796 | 2/1966 | Anderson | 148/11.5 A |

*Primary Examiner*—R. Dean

*Attorney, Agent, or Firm*—Robert H. Bachman

[57] ABSTRACT

A clip exhibiting improved corrosion resistance and reduced weight is processed by a drawing operation which is preferably conducted without interannealing treatments and which may employ a variation of drawing speeds. The clip of the present invention is prepared from an aluminum base alloy comprising from about 0.05–6.0% silicon, about 0.10–0.8% iron, about 0.02–0.3% copper, up to 1.0% manganese and up to 7.0% magnesium. The resulting clips possess comparable tensile properties to conventional tin and zinc-coated steel clips with an economy of processing.

8 Claims, 2 Drawing Figures

METHOD FOR PREPARING AN ALUMINUM CLIP

BACKGROUND OF THE INVENTION

The present invention relates generally to the manufacture of clips from wire materials, and particularly concerns the manufacture of clips such as paper clips, hair clips and the like from aluminum base alloys.

In the manufacture of clips such as paper clips, certain materials have been characteristically employed because of their low cost and plentiful supply. Thus, various copper alloys and certain steels have been widely employed.

One of the problems facing the manufacture of paper clips has been the corrosion resistance of the starting materials. Materials such as the conventionally employed steels tend to rust and corrode merely by atmospheric exposure over short periods of time, and have, accordingly, required some type of corrosion prevention treatment. Usually, in the case of the steel, this treatment comprises an initial plating of the finally reduced drawn wire with copper, followed by hot dip coating of the plated wire with materials such as tin and zinc. This type of processing is obviously both costly and time consuming, as the finally drawn wire must be run through the appropriate baths and the like to provide the desired coating. Recently, additional concern has arisen over the short supply of steel wire which has been employed in the manufacture of paper clips. This supply problem, coupled with the aforenoted costs of corrosion protection, has prompted consideration of alternative methods and materials.

The present invention is believed to overcome the aforenoted difficulties in an unexpected manner.

SUMMARY OF THE INVENTION

In accordance with the present invention, the preparation of a clip from an aluminum base alloy is disclosed which comprises a drawing operation requiring no interannealing treatments. The clip thus prepared possesses tensile properties which are favorably comparable with those of conventional steel clips, due to the processing of the present clip to a superstrength temper.

The method of the present invention includes a drawing operation which can be successfully conducted without the employment of conventional interannealing treatments. This is surprising as the drawing of aluminum base alloys suitable for the present invention has characteristically suffered from a high break frequency caused by sustained continuous drawing. Accordingly, the above noted continuous drawing of the present invention is preferably conducted at reduced drawing speeds to minimize breakage. The improved tensile properties resulting from this treatment are retained over an extended period of time which more than compensates for any room temperature age-softening which is observed to occur.

Accordingly, it is a principal object of the present invention to provide improved clips for a wide variety of applications which may be economically prepared from a low-cost starting material.

It is a further object of the present invention to provide clips as aforesaid which are prepared from an aluminum base alloy and which exhibit improved corrosion resistance.

It is still a further object of the present invention to prepare clips as aforesaid by a continuous drawing process which requires no interannealing treatments and minimizes the frequency of wire breakage.

It is yet a further object of the present invention to provide clips as aforesaid which possess comparable tensile properties to conventional clips.

Further objects and advantages will be apparent to those skilled in the art from a consideration of the description which follows with reference to the accompanying drawings.

DETAILED DESCRIPTION

In accordance with the present invention, a clip possessing improved corrosion resistance and reduced weight is prepared from and aluminum base alloy which comprises from about 0.05–6.0% silicon, about 0.10–0.8% iron, about 0.02–0.3% copper, up to about 1.0% manganese and up to about 7.0% magnesium, balance aluminum. In addition to the above elements, the alloys may also contain from about 0.05–0.20% chromium, up to about 0.2% titanium and up to about 0.1% zinc. In a preferred embodiment, the clip may be prepared from an aluminum alloy comprising from about 4.5–5.6% magnesium, from about 0.05–0.20% manganese, and from about 0.05–0.20% chromium. This preferred alloy may further contain silicon in an amount ranging up to 0.30%, iron in an amount ranging from 0.40%, copper in an amount ranging up to 0.10% and zinc in an amount ranging up to 0.10%. In addition to these elements, other elements may be present in amounts which do not effect the properties of the alloys and may range in total up to a level of 0.15% of the alloy.

The particular alloys employed in accordance with the present invention have been found to provide unexpected ease of processing and maximum tensile properties over an extended length of time.

As stated earlier, the clips of the present invention may be processed expeditiously by a drawing operation requiring no interannealing treatment. Specifically, materials such as the aluminum base alloys presently utilized, have conventionally required interannealing during extended drawing operations, as breakage of the workpiece frequently results from the extended tension exerted thereon. The surprising discovery that such conventional interanneals can be omitted without sacrificing processing efficiency and product quality is believed to constitute a significant advance in the art.

The specific processing of the alloys of the present invention, generally comprises provision of starting stock such as ⅜ inch redraw rod. The redraw rod may be drawn directly down to diameters suitable for clip applications, such as 0.045 inch and 0.036, inch respectively, for paper clip production. Conventional tin- and zinc-coated steel paper clips are prepared to a diameter of 0.036. Though the preferred processing of the present invention features the employment of a continual drawing operation without interannealing, the invention can, likewise, be practiced with a method which comprises drawing the aforestated rod to 0.205, inch annealing the resulting rod for 30 minutes at a temperature of about 600°–700° F, followed by drawing of the rod to the respective final diameters.

Figure 1:
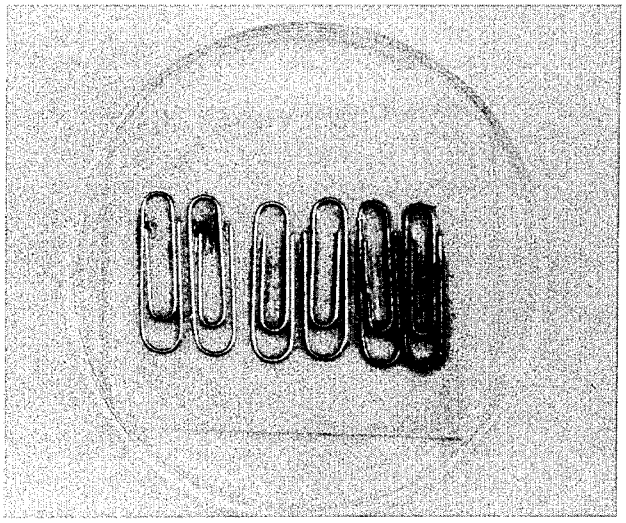
FIG. 1 is a photograph showing a comparison of a paper clip prepared in accordance with the present invention with conventional zinc and tin-coated paper clips after 18 hours of exposure to moisture.

The aluminum base alloy clips prepared in accordance with the present invention possess markedly superior corrosion resistance. Specifically, aluminum paper clips were prepared for comparison with conventional zinc- and tin-coated steel paper clips. Referring to FIG. 1, a photograph is shown of a test which was conducted with two samples selected from each of the aforementioned conventional steel paper clips and an aluminum paper clip prepared according to the present invention. The aluminum paper clips were placed in the center of the watch glass. After 18 hours, the two samples to the left of center representing the tin-coated steel paper clip had commenced rusting at their tips, and the two samples to the right comprising the zinc-coated clips exhibited substantial rust over most of their surface. The centrally located samples representative of the invention exhibited no rust or corrosion at all.

Figure 2:
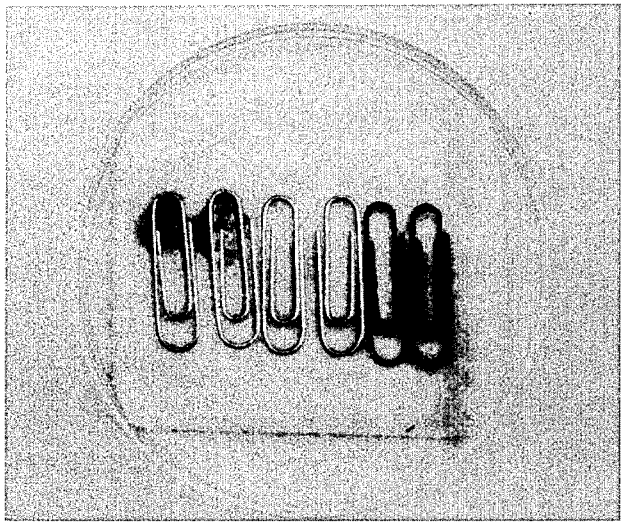
FIG. 2 is a photograph of a comparison of FIG. 1 after 95 hours of exposure.

The above test was conducted in an aqueous medium comprising ordinary tap water and was extended in duration from the 18 hours discussed above, to 95 hours, at which time and additional photograph was taken. Accordingly, FIG. 2 represents the photograph taken after 95 hours of exposure to moisture. The samples to the left of center are now pitted and discolored along their surfaces and significant rusting has occurred at their ends. The samples on the right are now totally rusted and blackened. The samples in the center, comprising the clips of the present invention, however, show no effect from this extended exposure to moisture and are virtually unchanged from their condition prior to the start of the test.

The above test graphically illustrates the improved corrosion resistance obtained by the use of the aluminum base clips of the present invention.

The combination of favorable tensile properties and ease of processing obtained by the present invention is demonstrated in the following illustrative examples.

EXAMPLE I

Several samples were prepared from representative aluminum base alloys including the alloy of the present invention. The compositions of these alloys is set forth in Table I, below.

TABLE I

| ALLOY NO. | NOMINAL COMPOSITION | | | | | | | | | |
|---|---|---|---|---|---|---|---|---|---|---|
| | Si | Fe | Cu | Mn | Mg | Cr | Zn | Ti | Be | Zr |
| 1 | 4.94 | 0.46 | 0.03 | 0.002 | 0.005 | 0.005 | 0.02 | 0.01 | 0.0005 | — |
| 2 | 0.07 | 0.14 | 0.03 | 0.08 | 4.96 | 0.08 | 0.02 | 0.008 | 0.001 | — |
| 3 | 1.18 | 0.39 | 0.02 | 0.14 | 0.81 | 0.14 | 0.01 | 0.03 | — | 0.08 |

Alloy 1 represents a high silicon content aluminum alloy, while alloy 3 represents an aluminum base alloy possessing relatively high silicon and magnesium contents. Alloy 2, representing the alloys of the present invention, contains a high magnesium content and has been found most useful in the manufacture of paper clips.

All of the samples were drawn to wire from redraw rod. Alloys 1 and 2 were conventionally prepared, while Alloy 3 was made from a 12 inch diameter DC cast ingot which was rod rolled following a homogenization treatment of 1035° F. The alloys were processed in various manners in accordance with the schedules outlined below:

PROCESS A

⅜ inch redraw rod drawn to 0.205 inch diameter, then annealed for three minutes at 660° F. Drawing resumed to 0.052, 0.045 and 0.036 inch diameters, respectively, with individual samples.

PROCESS B

⅜ inch redraw rod drawn to 0.205 inch diameter, then annealed for three minutes at 660° F. Drawing resumed to 0.045 and 0.036 inch diameters, respectively, with individual samples. All samples then given stabilization treatment of 275° F for three hours.

PROCESS C

⅜ inch redraw rod drawn directly to 0.035 and 0.036 inch diameters, respectively, with individual samples.

PROCESS D

⅜ inch redraw rod drawn directly to 0.045 and 0.036 inch diameters, respectively, with individual samples. All samples then given stabilization treatment of 275° F for three hours.

PROCESS E (for Alloy 3 only)

⅜ inch redraw rod drawn to 0.205 inch diameter, annealed for 30 minutes at 1050° F, then water quenched. Drawing resumed to 0.052, 0.045 and 0.036 inch diameters, respectively, with individual samples.

PROCESS F: (for Alloy 3 only)

⅜ inch redraw rod drawn to 0.205 inch diameter, annealed for 30 minutes at 1050° F, then water quenched. Samples aged for 5 hours at 350° F, then drawn to 0.052, 0.045 and 0.036, inch respectively, with individual samples.

The samples prepared above were tested for tensile properties and subsequently fabricated into paper clips. A control sample was prepared comprising tin- coated steel wire of 0.036 inch diameter, which was, likewise, subjected to identical testing. The various diameters prepared from the aluminum samples were selected on the basis of the diameter of the steel control sample and its relation to load carrying capacity of the wire. Calculations were based on torsional loading which was found to be related to the cube of the diameter of the wire. The tensile results for the various alloy samples are presented in Table II, below.

TABLE II

| ALLOY NO. - PROCESS | DIAMETER INCHES | Tensile Properties 0.2% YS (ksi) | UTS ksi | Percent Elongation 2" | 10" |
|---|---|---|---|---|---|
| Sn Coated Steel - Control | .0360 | 119.0 | 142.5 | 2.7 | 1.7 |
| 1 A | .0375 | 32.0 | 38.4 | 2.7 | 1.5 |
| 1 A | .0446 | 32.3 | 38.2 | 2.5 | 1.7 |
| 1 A | .0509 | 31.6 | 37.5 | 2.0 | 1.8 |
| 2 A | .0378 | 68.0 | 70.7 | 5.0 | 2.0 |
| 2 A | .0448 | 65.6 | 69.6 | 5.0 | 2.0 |
| 2 A | .0510 | 62.5 | 67.1 | 7.0 | 3.0 |
| 2 B | .0376 | 55.9 | 64.1 | 7.0 | 5.8 |
| 2 B | .0446 | 53.5 | 62.7 | 4.2 | 4.5 |
| 2 C | .0358 | 72.9 | 77.9 | 2.5 | 1.2 |
| 2 C | .0443 | 71.8 | 73.7 | 3.5 | 2.0 |
| 2 D | .0371 | 57.8 | 66.7 | 4.3 | 4.5 |
| 2 D | .0443 | 58.0 | 67.1 | 6.2 | 5.2 |
| 3 E | .0371 | 63.9 | 66.5 | 1.0 | .6 |
| 3 E | .0447 | 65.8 | 65.8 | 1.0 | .2 |
| 3 E | .0540 | 60.3 | 64.3 | 4.0 | 1.6 |
| 3 F | .0372 | 71.5 | 76.8 | 1.3 | 0.7 |
| 3 F | .0448 | 76.7 | 77.4 | 1.5 | 0.8 |
| 3 F | .0541 | 69.2 | 74.9 | 1.6 | 1.1 |

Referring to Table II, above, Alloy 3, prepared by Process F, was noted to have the highest yield strength at 0.045 inch diameter followed by Alloy 2 prepared by Process C. Softening of Alloy 3 in this condition was noted when the alloy samples prepared at 0.0372 and 0.0448 inch diameters are compared. The yield strength of Alloy 1 at a comparable diameter of 0.0446 which was prepared by Process A, was only about 32.3 ksi, significantly below that of Alloys 2 and 3. This data suggests that improved tensile properties are obtained with Alloys 2 and 3, and of these, Alloy 2 exhibits a uniformly higher tensile strength.

It is noteworthy that the addition of the stabilization annealing treatment to the preparation of Alloy 2 in its preparation be Process D resulted in a decrease in yield strength at both diameters. This suggests that continual drawing without post-stabilization is preferable for this alloy,

EXAMPLE II

The samples prepared in Example I were then fabricated into paper clips and then tested for load-deflection characteristics. The clips were suspended on the outer edges. The interior loop of the clip was left unsupported and a weight of predetermined quantity was attached to the curved portion thereon. Two loads, of 60.0 and 124.4 grams, respectively, were used. The results are set forth in Table III, below.

TABLE III

| Alloy No. - Process | Diameter (inches) | Deflection 60 gm. Load (millimeters) | Deflection 124.4 gm. Load (millimeters) |
|---|---|---|---|
| Sn Coated Steel - Control | 0.036 | 1.52 | 3.02 |
| 1 A | 0.038 | 4.97 | Not measured |
| 1 A | 0.045 | 2.25 | 5.97 |
| 1 A | 0.051 | 1.13 | 2.12 |
| 2 A | 0.038 | 2.94 | 5.85 |
| 2 A | 0.045 | 1.61 | 2.80 |
| 2 A | 0.051 | 0.61 | 1.68 |
| 2 B | 0.036 | 2.99 | 6.82 |
| 2 B | 0.045 | 1.47 | 3.79 |
| 2 C | 0.036 | 3.35 | 5.88 |
| 2 C | 0.045 | 1.44 | 3.16 |
| 2 D | 0.036 | 3.45 | 6.45 |
| 2 D | 0.045 | 1.78 | 3.36 |
| 3 E | 0.037 | 3.37 | 6.62 |
| 3 E | 0.045 | 1.26 | 3.40 |
| 3 E | 0.054 | 0.61 | 1.71 |
| 3 F | 0.037 | 3.29 | 6.76 |
| 3 F | 0.045 | 1.79 | 4.59 |
| 3 F | 0.054 | 0.46 | 1.63 |

From the above table, it can be seen that an increase in diameter of the aluminum wire to 0.045 inch is required to match the characteristics of the tin-coated steel wire. Of the samples tested, the samples prepared from Alloy 2 prepared by Processes A and C performed the best. Likewise, some performance was lost following the stabilization treatment provided by Processes B and D.

EXAMPLE III

Additional testing was carried out on the device described in sample 2 to determine the amount of load needed to place the paper clip in a permanent set. In this test, samples were drawn primarily from Alloys 2 and 3. The results of this test are presented in Table IV below.

TABLE IV

| ALLOY NO. - PROCESS | Diameter (inches) | Load* (grams) |
|---|---|---|
| Tin-Coated Steel Wire - Control | 0.036 | 250 |
| 2 A | 0.038 | 200 |
| 2 A | 0.045 | 320 |
| 2 C | 0.036 | 180 |
| 2 C | 0.045 | 350 |
| 2 B | 0.038 | 170 |
| 2 B | 0.045 | 280 |
| 2 D | 0.037 | 160 |

TABLE IV-continued

| ALLOY NO. - PROCESS | | Diameter (inches) | Load* (grams) |
|---|---|---|---|
| 2 | D | 0.045 | 320 |
| 3 | E | 0.037 | 170 |
| 3 | E | 0.045 | 310 |

*Load required to produce permanent set. At permanent set a sheet of tablet paper could be slipped between the center and outer legs of the paper clip after the load was removed.

From the above table, it is apparent that Alloy 2, prepared by Process C performs better than the other aluminum alloys tested. Further, it is observed that if permanent set were used as the design citerion for paper clips, a diameter of 0.040 inch for a paper clip prepared from Alloy 2 by Process C would be required to match the properties of tin-coated steel wire.

The above tests confirm that the alloys employed in the process of the present invention when processed by a continual drawing operation omitting interannealing treatment yield clips possessing comparable strength and resiliency to conventional steel clips.

In addition to the processing outlined above, it has been found that the drawing speed employed in the process of the present invention may be favorably varied to yield products possessing improved tensile properties for extended time periods without the need of a post-drawing stabilization treatment. Specifically, the process of the present invention may be practiced at drawing speeds of up to 4,000 feet per minute. The upper limitation of this range is satisfactory from an efficiency standpoint as little or no difficulty is encountered with wire breakage and the like. Further, this higher drawing speed was found to provide an implicit stabilization anneal which is conventionally employed to render the properties of the resulting product stable for extended periods of time. Though the higher drawing speed is satisfactory, it has been found that a drawing speed of half that value, or 2,000 feet per minute, can be employed which yields products of improved tensile strength and does not require a stabilization treatment.

The significance of the above discovery will be made clearer through a consideration of the tests set forth in the following examples.

EXAMPLE IV

Several samples of Alloy 2 prepared by Process A were drawn at speeds of 2,000 and 4,000 feet per minute, respectively, on different occasions and then tested on a single subsequent date for tensile properties and elongation. The results of these tests are presented in Table V, below.

TABLE V

ALLOY NO. 2 PREPARED BY PROCESS A
As-Received Tensile Properties

| SAMPLE NO.* | DRAWING RATE | DRAWING DATE | 0.2 Y.S. (ksi) | Ten. Str. (ksi) | Elong. (10") |
|---|---|---|---|---|---|
| 1 | 2000 fpm | Drawn 11/5/74 | 65.5 | 69.0 | 4.7 |
| 2 | 4000 fpm | Drawn 11/5/74 | 60.8 | 62.7 | 4.2 |
| 3 | 2000 fpm | Drawn 6/21/74 | 62.1 | 69.3 | 4.2 |
| 4 | 2000 fpm | Drawn 11/5/74 | 65.5 | 68.9 | 2.7 |
| 5 | 4000 fpm | Drawn 11/5/74 | 61.2 | 65.4 | 4.6 |

*Samples 1–3 tested 11/13/74. Samples 4 and 5 tested 11/19/74.

Referring to the above table, it can be seen that the samples drawn at the slower drawing speed uniformly exhibited high tensile properties. It is, likewise, noteworthy that the sample drawn on 6/21/74 at 2,000 feet per minute possessed retained properties which were higher than those of samples more recently prepared at the higher drawing speed. This data alone suggests that the stabilization treatment is not necessary at the lower drawing speeds.

EXAMPLE V

The samples prepared in Example IV were fashioned into paper clips and tested for load-deflection in a similar manner to Example II. The results of this testing, including a comparison with tin-coated steel, are set forth in Table VI, below.

TABLE VI

Load-Deflection Characteristics

| DRAWING RATE | DRAWING DATE | Load* (gms) | Total Deflection* (Inches) |
|---|---|---|---|
| 2000 fpm | Drawn 11/5/74 | 280 | 0.40 |
| | | 270 | 0.41 |
| | | 260 | 0.39 |
| | | 260 | 0.38 |
| Tin-Coated Steel - Control | | 250 | 0.25 |
| 4000 fpm | Drawn 11/5/74 | 240 | 0.40 |
| | | 240 | 0.38 |
| | | 240 | 0.39 |
| | | 240 | 0.40 |

*Load and total deflection to cause permanent set in paper clip equal to thickness of piece of paper.

From the above table, it is noted that the load capacity of the wire prepared at the slower drawing speed for greater than that of the tin-coated steel, while that of the wire drawn at 4,000 feet per minute is slightly less. The deflection of both aluminum alloy wires were greater than that of the steel wire.

EXAMPLE VI

Samples of wire identical to that employed in Examples IV and V were annealed at temperatures of 120°, 170° and 275° F for periods of time of up to 100 hours, to determine the relative thermal stability of the two types of wires. Tensile properties were measured and are presented in Table VII, VIII and IX, respectively, presented below.

TABLE VII

| Drawing Speed/Annealing Time | Tensile Properties Annealed at 120° F 0.2% Y.S. (ksi) | Ten. Str. (ksi) | % Elong. (10") |
|---|---|---|---|
| 2000 fpm/1 hr. | 65.7 | 69.2 | 4.2 |
| 4000 fpm/1 hr. | 60.7 | 64.0 | 4.3 |
| 2000 fpm/8 hrs. | 65.1 | 68.9 | 4.3 |
| 4000 fpm/8 hrs. | 61.2 | 64.2 | 4.1 |
| 2000 fpm/16 hrs. | 65.4 | 69.1 | 4.3 |
| 4000 fpm/16 hrs. | 60.3 | 62.8 | 4.1 |
| 2000 fpm/50 hrs. | 65.6 | 69.7 | 4.3 |
| 4000 fpm/50 hrs. | 60.6 | 64.2 | 4.5 |
| 2000 fpm/100 hrs. | 65.8 | 69.0 | 4.8 |
| 4000 fpm/100 hrs. | 60.1 | 63.5 | 4.2 |

TABLE VIII

| Drawing Speed/Annealing Time | Tensile Properties Annealed at 170° F 0.2% Y.S. (ksi) | Ten.Str. (ksi) | % Elong. (10") |
|---|---|---|---|
| 2000 fpm/1 hr. | 64.7 | 67.4 | 3.1 |
| 4000 fpm/1 hr. | 61.1 | 63.9 | 4.3 |
| 2000 fpm/4 hrs. | 64.3 | 68.3 | 4.7 |
| 4000 fpm/4 hrs. | 61.0 | 64.1 | 4.2 |
| 2000 fpm/8 hrs. | 63.9 | 66.3 | 4.2 |
| 4000 fpm/8 hrs. | 60.9 | 64.0 | 4.3 |
| 2000 fpm/16 hrs. | 63.5 | 67.4 | 4.3 |
| 4000 fpm/16 hrs. | 61.1 | 62.8 | 4.1 |
| 2000 fpm/50 hrs. | 63.3 | 67.1 | 3.9 |
| 4000 fpm/50 hrs. | 61.2 | 64.5 | 4.0 |
| 2000 fpm/100 hrs. | 63.3 | 66.1 | 3.8 |
| 4000 fpm/100 hrs. | 60.9 | 63.9 | 4.1 |

TABLE IX

| Drawing Speed/Annealing Time | Tensile Properties Annealed at 275° F 0.2% Y.S. (ksi) | Ten. Str. (ksi) | % Elong. (10") |
|---|---|---|---|
| 2000 fpm/1 hr. | 62.8 | 66.2 | 4.1 |
| 4000 fpm/1 hr. | 60.4 | 63.5 | 4.2 |
| 2000 fpm/4 hrs. | 61.5 | 66.3 | 3.8 |
| 4000 fpm/4 hrs. | 59.8 | 63.4 | 3.7 |
| 2000 fpm/8 hrs. | 61.1 | 66.2 | 3.3 |
| 4000 fpm/8 hrs. | 59.8 | 63.2 | 3.8 |
| 2000 fpm/16 hrs. | 60.0 | 65.8 | 3.7 |
| 4000 fpm/16 hrs. | 59.4 | 63.7 | 3.6 |
| 2000 fpm/50 hrs. | 58.2 | 66.1 | 4.9 |
| 4000 fpm/50 hrs. | 57.6 | 64.5 | 5.7 |

Referring to the above tables, the data obtained from the annealing treatment at 120° F suggests that no significant change in yield strength occurs even after 100 hours at temperature.

The data for the wires annealed at 170° F, set forth in Table VIII, indicates no change in the yield strength of the wire drawn at 4,000 feet per minute for times up to 100 hours. The wire drawn at 2,000 feet per minute appear to have lost about 2 ksi yield strength. A conservative extrapolation of the data to estimate the time at which yield strengths of the respective samples will be equal results in a time of 1,200 hours, or 50 days. It can clearly be seen that the retention of properties by the respective samples is such that the stabilization treatment is virtually unnecessary.

The data presented in Table IX for the annealing response of the samples at 275° F shows that the yield strengths drop off for all samples but somewhat faster for the samples drawn at the slower speed. Carrying out a similar extrapolation to that which is made with the samples processed at 170° F, it is determined that the estimated annealing time at which the yield strengths of the respective samples would be equal for approximately 140 hours. Considering that this comparison is made at the elevated temperature of 275° F, it is, nonetheless, surprising that the clip prepared by the slow drawing speed maintains its improved properties for the above noted period of time. From the above, it is clear that the method for the present invention may be conducted at a slower drawing speed without the requirement of a post-drawing annealing treatment. The employment of this slower drawing speed, thus, achieves an economy of processing and, likewise, minimizes the possibility of breakage which may remotely exist in the drawing process employed herein.

Though the above examples relate primarily to the comparison of paper clips, the invention is not limited thereto, as other clip products such as hair clips, straight pins and the like could be similarly manufactured. All of such products would greatly benefit from the acquisition of favorable tensile properties, with reduced corrosivity, weight and cost. Thus, for example, paper clips prepared in accordance with the invention demonstrate reduced weight, improved corrosion resistance and comparable tensile properties to conventional steel clips at a significantly reduced cost of materials and processing.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for the preparation of an aluminum paper clip possessing improved corrosion resistance and reduced weight which comprises:

A. providing an aluminum base alloy in rod form, said aluminum base alloy consisting essentially of from about 0.05–6.0% silicon, from about 0.10–0.8% iron, from about 0.02–0.3% copper, from about 0.05–0.20% chromium, from about 0.05–0.20% manganese and from about 4.5–5.6% magnesium, balance aluminum;

B. drawing said rod into wire of a diameter ranging from about 0.035–0.055 inches by a continual drawing operation which is conducted at a speed ranging from about 2,000 to about 4,000 feet per minute without an interannealing treatment; and C. bending a finite length of said wire into the shape of a paper clip.

2. The method of claim 1 wherein from about 0.05–0.20% chromium, up to about 0.2% titanium, and up to about 0.1% zinc are added to said alloy.

3. The method of claim 1 wherein silicon is present in a maximum amount of 0.30%, iron is present in a maximum amount of 0.40%, copper is present in a maximum amount of 0.10% and zinc is present in an amount up to 0.10%.

4. The method of claim 1 further including annealing said wire after the completion of said drawing.

5. The method of claim 4 wherein said annealing is conducted at a temperature ranging up to about 300° F for from 1–50 hours.

6. The method of claim 5 wherein said annealing is conducted at a temperature of about 275° F for about 3 hours.

7. The method of claim 1 wherein said diameter ranges from 0.036–0.048.

8. An aluminum paper clip possessing improved corrosion resistance and reduced weight, prepared from an aluminum base alloy consisting essentially of from about 0.05–6.0% silicon, from about 0.10–0.8% iron, from about 0.02–0.3% copper, from about 0.05–0.20% chromium, from about 0.05–0.20% manganese and from about 4.5–5.6% magnesium, balance aluminum, said clip prepared by a process which comprises:

A. providing said aluminum base alloy in rod form;

B. drawing said rod into wire of a diameter ranging from about 0.035–0.055 inches by a continual drawing operation which is conducted at a speed ranging from about 2,000 to about 4,000 feet per minute without an interannealing treatment; and C. bending a finite length of said wire into the shape of a paper clip.

* * * * *